United States Patent [19]

Bucher

[11] Patent Number: 4,599,997

[45] Date of Patent: Jul. 15, 1986

[54] MASSAGE APPARATUS WITH A DISENGAGEABLE VIBRATORY MASSAGE PLATE

[75] Inventor: Heinz Bucher, Rottweil, Fed. Rep. of Germany

[73] Assignee: Metronic Electronic GmbH, Fed. Rep. of Germany

[21] Appl. No.: 534,337

[22] Filed: Sep. 21, 1983

[30] Foreign Application Priority Data

Oct. 8, 1982 [DE] Fed. Rep. of Germany ..... 3237333

[51] Int. Cl.[4] ..... A61H 1/00

[52] U.S. Cl. ..... 128/36; 128/25 B; 128/32; 4/574

[58] Field of Search ..... 128/24.2, 24.3, 32, 128/33, 34, 35, 36, 25 B, 65, 66; 4/574

[56] References Cited

U.S. PATENT DOCUMENTS

| | | | |
|---|---|---|---|
| 884,027 | 4/1908 | Manker | 128/33 |
| 3,055,357 | 9/1962 | Redka | 128/32 |
| 3,169,521 | 2/1965 | McCaw | 128/33 X |
| 3,283,756 | 11/1966 | Turley | 128/25 B |
| 3,322,117 | 5/1967 | McCaw | 128/33 |
| 3,890,963 | 6/1975 | Patterson | 128/36 X |

FOREIGN PATENT DOCUMENTS

| | | |
|---|---|---|
| 1887408 | 2/1964 | Fed. Rep. of Germany . |
| 6806705 | 3/1969 | Fed. Rep. of Germany . |
| 7720423 | 12/1977 | Fed. Rep. of Germany . |

*Primary Examiner*—Richard J. Apley
*Assistant Examiner*—Robert W. Bahr
*Attorney, Agent, or Firm*—Thomas W. Speckman

[57] ABSTRACT

A massage apparatus having a vibratory massage plate, the vibratory motion of which is derived from a drive unit rotated by an electric motor and an insertable portion of a drive shaft in operative engagement with the drive unit. In order to perform underwater massage in addition to dry vibration massage, the invention provides for a container having a drive shaft rotatably mounted in its bottom portion. The drive shaft has an impeller or the like mounted thereon inside the container and has an insertable portion on the shaft projecting from the underside of the container bottom. The massage plate has an opening in the area of the drive unit to receive the insertable portion of the drive shaft, and on insertion of the insertable portion of the drive into a receptacle of the drive unit, an operative engagement between the insertable portion of the drive shaft and the drive unit is established. Disengagement of the drive unit and the insertable portion of the drive shaft is effected by axial movement of the drive unit.

19 Claims, 4 Drawing Figures

MASSAGE APPARATUS WITH A DISENGAGEABLE VIBRATORY MASSAGE PLATE

BACKGROUND OF THE INVENTION

1. Field of the Invention

This invention relates to a massage apparatus having a vibratory massage plate, the vibratory motion of which is derived from a drive unit rotated by an electric motor and an adjusting means in operative engagement with the drive.

This type of massage apparatus comes in various structural designs. To receive a massage, the feet of a person are placed upon the massage plate, and the vibratory movements of the massage plate can usually be continuously regulated. Massage apparatus of this kind produce so called vibration massage only.

2. Description of the Prior Art

From German Utility Model Nos. DE-GM 68 06 705 and DE-GM 18 87 408 an underwater massage apparatus is known in which a container is placed on a vibrating plate. Vibrations are imparted to water in the container by the vibratory motion of the vibrating plate which is transferred to the container, and these vibrations are utilized for underwater massage. This device is limited to underwater massage.

German Utility Model No. DE-GM 77 28 423 discloses a massage apparatus in which the container for the water also has an air pump and a vibrator. The vibrator imparts vibratory motion to the water and the air pump generates air bubbles in the water. The vibration massage is limited to underwater massage and the effect of the massage is enhanced by the effervescence added to the water. However, the device requires a vibrator and an air pump.

SUMMARY OF THE INVENTION

It is an object of the present invention to provide a massage apparatus of the first mentioned kind whose functional scope is expanded in a simple and inexpensive manner to perform underwater massage while also retaining the dry vibration massage option.

This is accomplished according to the invention in that a container is mounted above the massage plate, the container has a rotatably mounted drive shaft in its bottom portion, the drive shaft of the container has an impeller or the like mounted thereon and has an insertable portion which projects from the underside of the container bottom, the massage plate has an opening in the area of the drive unit to receive the insertable portion of the drive shaft, and that on insertion of the insertable portion into the receptacle of a drive unit an operative engagement between such insertable portion of the drive shaft and the drive unit is established, and disengagement of the drive unit and the receptacle of the massage plate is effected by movement of the drive unit.

In this embodiment, the container has mounted therein only the drive shaft with the impeller or the like thereon. Driving of the impeller is supplied by the drive of the massage plate, so that no special drive means is needed for the underwater massage mode. Since the operative engagement between the drive unit and the massage plate is broken when the container sits on the massage plate, the power capacity of the drive designed for the vibration massage plate is sufficient also for the underwater massage. By the rotary motion of the impeller or the like in the interior of the container, vibrations are communicated to the water in the container which are sufficient for an appropriate degree of underwater massage.

According to another embodiment, the receptacle receiving the drive shaft takes the form of an eccentric which is rotatably mounted by a ball bearing in a sleeve-shaped adjunct on the underside of the massage plate. The eccentric can remain in that appended portion of the massage plate and, when the container is placed upon or removed from the massage plate, it is merely necessary to disengage the drive unit from the eccentric or to reestablish the operative engagement, respectively.

The operative engagement is produced in that the drive unit is constructed in the form of a sleeve which is divided by a partition into a receiving section for an insertable portion of the drive shaft and a receiving section for a spring, that the sleeve is provided on its circumference with longitudinally extending ribs or splines for insertion into grooves provided in an inner receptacle of the eccentric, that a compression spring is provided to hold the drive unit with its ribs thereon in engagement with the grooves in the eccentric when the insertable portion of the drive shaft is not inserted, and that the sleeve-shaped drive unit with its ribs thereon is additionally in engagement with grooves provided in a receptacle formed by a hub of a drive wheel. The compression spring ensures that the operative engagement between the drive unit and the eccentric constituting the adjusting device for the massage plate is automatically reestablished when the container is removed from the massage plate.

To produce an operative connection between the insertable portion of the drive shaft and the drive unit, another embodiment provides that the receptacle of the drive unit has longitudinally extending ribs thereon which are introduced into grooves in the insertable portion of the drive shaft and thereby produce the operative engagement between drive unit and drive shaft.

To ensure that the drive unit is in a definitive position with respect to the eccentric when the container is removed from the massage plate, another embodiment provides for the inner receptacle of the eccentric to have a stop facing the massage plate, which stop determines the end position of the spring loaded drive unit.

A safe disengagement between the eccentric and the drive unit, as the container is placed upon the massage plate, is achieved according to another embodiment, in that the insertable portion of the drive shaft projects from the container bottom a distance such that the drive unit, with the container being placed on the massage plate, can be moved to a position in a receptacle of the drive wheel a distance such that the drive unit is completely disconnected from the inner receptacle of the eccentric.

According to another embodiment, the mounting of the drive wheel and the drive unit axially movable in the wheel hub in the housing of the massage apparatus is such as to provide the hub of the drive unit rotatably mounted by means of ball bearings in a sleeve-shaped bearing portion of the upper section of the housing of the massage apparatus.

To avoid contact with the impeller or the like in the interior of the container so as not to impede the transfer of vibrations to the water in the container, another embodiment provides for the impeller or the like to be covered on the side of the inner space of the container with a cover plate having apertures therein.

In order that the container may be placed on the massage apparatus without contact with the massage plate, the container has an offset portion or rim around the lower portion of its periphery and is placed with that rim upon a support ledge projecting on all sides from the upper section of the housing. In this manner, the container is automatically centered by the massage plate and its placement rim so that the drive shaft by necessity is aligned through an opening in the massage plate to extend into the receptacle of the drive unit.

The massage plate itself is provided on its upper side with knobs or studs or the like and bears against the upper section of the housing by way of resilient support elements. Thus, the massage plate due to its particular vibratory mounting is not affected by the load of the container placed on the massage plate, nor are the protuberances on its top.

According to another embodiment, the drive of the drive wheel, including the drive unit axially adjustable in the wheel hub, is so constructed that a housing portion adjacent the massage plate accommodates an electric motor including a driven shaft and a driven wheel, with the driven wheel being coupled to the drive wheel by a belt or the like.

BRIEF DESCRIPTION OF THE DRAWING

The invention will be described in further detail with reference to embodiments illustrated in the drawings, in which.

DESCRIPTION OF PREFERRED EMBODIMENTS

Figure 1:
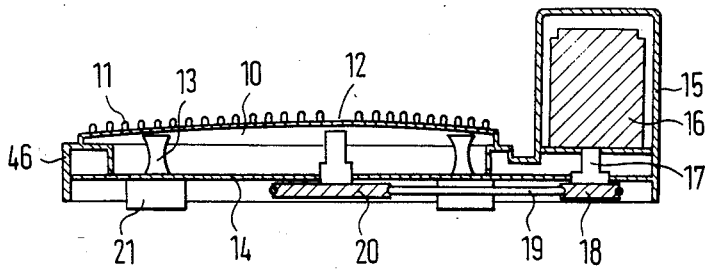
FIG. 1 is a diagrammatic sectional view of a massage apparatus according to the invention, in the vibration massage mode.

The sectional view of FIG. 1 shows the structure of the massage apparatus as it is normally used for dry vibration massage. The massage plate 10 is provided on its upper surface with protuberances 11 which may be designed as to shape and geometric distribution to produce an especially beneficial massage effect on any given reflex zone. Massage plate 10 is joined to upper housing section 14 by resilient support members 13 which are capable of following the vibrating movements of massage plate 10. On one side of massage plate 10, lower housing portion 15 holds electric motor 16 including driven shaft 17 and driven wheel 18. Driven wheel 18 is in operative connection with drive wheel 20 by bar or belt 19 or the like.

Figure 3:
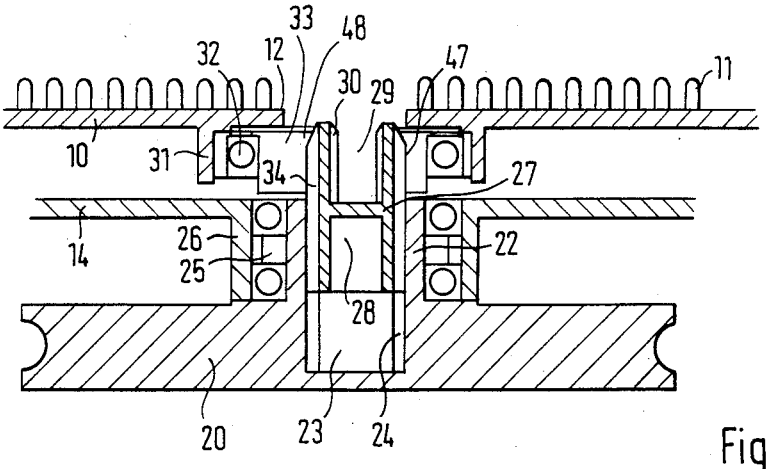
FIG. 3 is a partial sectional view illustrating the operative engagement between the drive unit and the adjusting device of the massage plate in the vibration massage mode.

As is shown in the partial sectional view of FIG. 3, drive wheel 20 has hub 22 which is rotatably mounted by ball bearings 25 in sleeve-shaped bearing appendage 26 of upper housing section 14. Hub 22 forms receptacle 23 for drive unit 27 which is axially adjustable in receptacle 23 but is secured against rotation in receptacle 23 by the ribs or splines 34 on drive unit 27 and grooves 24 in receptacle 23. These longitudinally extending ribs 34 and grooves 24 interact to securely hold drive unit 27 against rotation in receptacle 23, but permit an axial adjustment of drive unit 27 in receptacle 23. The location of the ribs and grooves may also be reversed.

Drive unit 27 is sleeve-shaped and is divided by a partition into two sections 28 and 29. Section 28 serves to receive a compression spring, not illustrated, which bears against the bottom of receptacle 23 and the partition wall in drive unit 27. The compression spring acts to maintain drive unit 27 in the position shown in FIG. 3. Ribs 34 on the exterior of drive unit 27 are mated with grooves provided in inner receptacle 47 of engagement means eccentric 33. Stops 48 on inner receptacle 47 serve to limit the extent of insertion of drive unit 27 into inner receptacle 47 of eccentric 33. With drive wheel 20 in operation, drive unit 27 rotates along with it and, due to the operative engagement between drive unit 27 and eccentric 33, vibratory motion is imparted to massage plate 10. Eccentric 33 is rotatably mounted by means of ball bearings 32 in sleeve-shaped adjunct 31 of massage plate 10.

Figure 2:
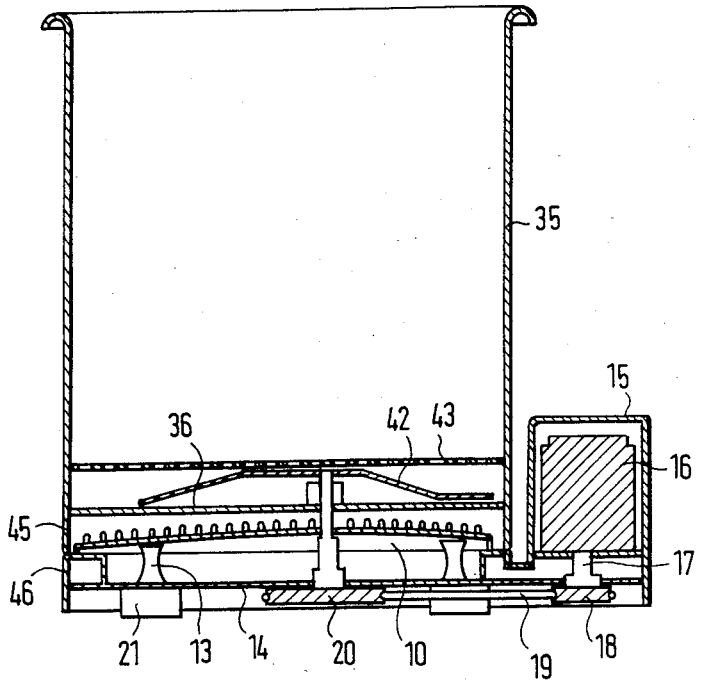
FIG. 2 is a similar sectional view of a massage apparatus according to the invention in the underwater massage mode.
Figure 4:
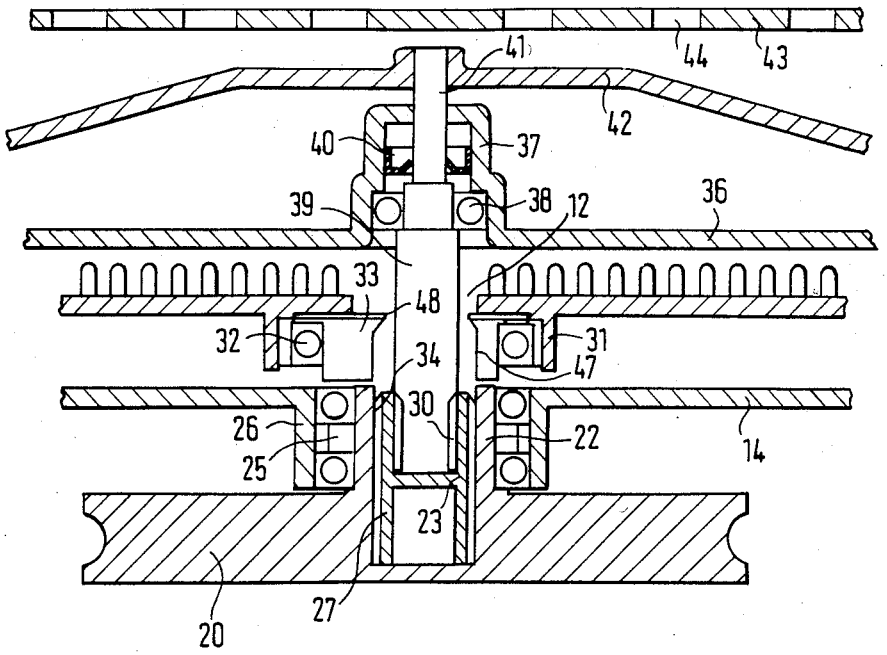
FIG. 4 is a partial sectional view illustrating the operative engagement between the drive shaft of the container and the drive unit, and the operative disengagement of the drive unit and the adjusting device of the massage plate.

Section 29 of drive unit 27 is of the socket type, with longitudinally extending interior ribs or ridges 30. Massage plate 10 has an aperture 12 located above the socket type receptacle 29 of drive unit 27. FIG. 2 shows how container 35 may be placed with its rim 45 upon support 46 which extends all around massage plate 10 and projects somewhat from it, so that drive shaft 41, which is rotatably mounted in bottom 36, is coupled to drive unit 27, shown in the sectional view of FIG. 4. Drive shaft 41 projects with its insertable plug-type portion 39 from the underside of bottom 36 and is inserted into socket-type receptacle 29 of drive unit 27. Insertable part 39 is provided with longitudinal grooves for ribs 30 of receptacle 29. Insertable part 39 projects from bottom 36 of container 35 a distance such that drive unit 27, as container 35 is placed upon support 46, is pushed into receptacle 23 of drive wheel 20 a distance by which it is completely moved out of inner receptacle 47 of eccentric 33. During this mode of operation, the compression spring is kept biased, aided by the weight of the water in container 35. Thus, the operative connection between drive unit 27 and eccentric 33 is disconnected and drive shaft 41 is now rotated with the rotational movement of drive wheel 20 and the drive unit 27. Drive shaft 41 is stepped and is rotatably mounted by ball bearings 38 in dome-shaped section 37 of bottom 36. This mounting location is sealed by sealing means 40. Drive shaft 41 protrudes from bearing dome 37 and has mounted thereon, inside the container, impeller 42 the rotary motion of which causes the water in the container to swirl or vibrate. A cover plate 43 having apertures therein is disposed above impeller 42 inside container 35 to prevent contact with impeller 42.

As will be seen from FIG. 2, container 35 is placed with its rim portion 45 upon support 46 provided in upper housing section 14, whereby this placement rim 45 surrounds massage plate 10 which is disposed at a slightly higher level. Thus, as container 35 is placed on support 46, it is so centered that drive shaft 41 is inserted through aperture 12 in massage plate 10 directly into receptacle 29 of drive unit 27.

The massage apparatus stands on legs 21. The upper housing portion 14 may also be joined to a lower housing portion by which all drive elements are covered.

I claim:

1. Massage apparatus capable of performing both underwater massage and dry vibration massage, the motion of each is derived through engagement means in operative engagement with a drive means rotated by an electric motor, said massage apparatus comprising: a vibratory massage plate (10) having an aperture (12) and an engagement means (33) with an off center through bore receptacle (47); a drive wheel (20) having a hub (22) and a receptacle (23) within said hub (22), where said receptacle (23) is aligned with said off center through bore receptacle (47); a sleeve-shaped drive unit (27) having a lower (28) and upper (29) receptacle, and being axially adjustable with respect to said drive wheel (20), where said engagement means (33) is engaged to by said drive means to impart a vibratory motion to said massage plate (10); and a container (35) above said massage plate (10), said container (35) having a drive shaft (41) rotatably mounted in its bottom portion (36), said drive shaft (41) having an impeller (42) mounted thereon inside said container (35) and having an insertable portion (39) projecting from the underside of said container (35) through said aperture (12) in said massage plate (10) and into non-rotatable engagement with said upper receptacle (29) of said drive unit (27) axially lowering said drive unit (27) into a lower axial position thereby establishing operative engagement in between said drive shaft (41) and said drive unit (27) to impart rotary motion to said impeller (42) and to effect disengagement of said drive unit (27) from said engagement means (33) of said massage plate (10).

2. Massage apparatus according to claim 1, wherein said engagement means (33) is an eccentric which is rotatably mounted by ball bearings (32) in a sleeve-shaped collar (31) on the underside of said massage plate (10).

3. Massage apparatus according to claim 2, wherein said drive unit (27) is constructed in the form of a sleeve which is divided by a partition into an upper receiving section (29) for receiving said insertable portion (39) and a lower receiving section (28) for a spring, that said sleeve is provided on its outer surface with longitudinally extending ribs (34) for mating with grooves provided in an inner receptacle (47) of said engagement means (33), that a compression spring holds said drive unit (27) with its ribs (34) in engagement with said grooves in said engagement means (33) when said insertable portion (39) is not inserted, and that said drive unit (27) with said ribs (34) thereon is additionally held in engagement with grooves (24) provided in a receptacle (23) formed by said hub (22) of said drive wheel (20).

4. Massage apparatus according to claim 1, wherein said container (35) has a placement rim (45) around the lower portion of its periphery which rim rests on a support (46) projecting on all sides from an upper housing section (14) extending beneath and beyond said massage plate (10).

5. Massage apparatus according to claim 3, wherein said receptacle (29) of said drive unit (27) has longitudinally extending ribs (30) thereon which mate with grooves on said inserted insertable portion (39) and thereby produce the operative engagement between said drive unit (27) and said drive shaft (41).

6. Massage apparatus according to claim 3, wherein said inner receptacle (47) of said engagement means (33) has a stop (48) facing said massage plate (10) which stop determines the end position of said spring loaded drive unit (27).

7. Massage apparatus according to claim 6, wherein said insertable portion (39) of said drive shaft (41) projects from said bottom (36) of said container (35) a distance such that said drive unit (27) with said container (35) being placed above said massage plate (10) is adjusted to extend into said receptacle (23) of said drive wheel (20) a distance as to be completely disconnected from said inner receptacle (47) of said engagement means (33).

8. Massage apparatus according to claim 3, wherein said insertable portion (39) of said drive shaft (41) projects from said bottom (36) of said container (35) a distance such that said drive unit (27) with said container (35) being placed above said massage plate (10) is adjusted to extend into said receptacle (23) of said drive wheel (20) a distance as to be completely disconnected from said inner receptacle (47) of said eccentric (33).

9. Massage apparatus according to claim 3, wherein said hub (22) of said drive wheel (20) is rotatably mounted by means of a ball bearing (25) in a sleeve-shaped bearing portion (26) provided at an upper housing section (14) of said massage apparatus extending beneath and beyond said massage plate (10).

10. Massage apparatus according to claim 7, wherein said hub (22) of said drive wheel (20) is rotatably mounted by means of a ball bearing (25) in a sleeve-shaped bearing portion (26) provided at an upper housing section (14) of said massage appartaus extending beneath and beyond said massage plate (10).

11. Massage apparatus according to claim 10, wherein said impeller (42) is covered on the side of the inner space of the container with a cover plate (43) having apertures (44) therein.

12. Massage apparatus according to claim 11, wherein said container (35) has a placement rim (45) around the lower portion of its periphery which rim rests on a support (46) projecting on all sides from said upper housing section (14).

13. Massage apparatus according to claim 12, wherein said massage plate (10) is provided on its upper side with knobs (11) or the like and is joined to said upper housing section (14) by resilient support elements (13).

14. Massage apparatus according to claim 13, wherein said massage apparatus includes a housing portion (15) adjacent said massage plate (10) which accommodates an electric motor (16) having a driven shaft (17) and a driven wheel (18) whereby said driven wheel (18) is coupled to said drive wheel (20) by a belt (19).

15. Massage apparatus according to claim 1, wherein said drive unit (27) is constructed in the form of a sleeve which is divided by a partition into an upper receiving section (29) for receiving said insertable portion (39) and a lower receiving section (28) for a spring, that said sleeve is provided on its outer surface with longitudinally extending ribs (34) for mating with grooves provided in an inner receptacle (47) of said engagement means (33), that a compression spring holds said drive unit (27) with its ribs (34) in engagement with said grooves in said engagement means (33) when said insertable portion (39) is not inserted, and that said drive unit (27) with said ribs (34) thereon is additionally held in engagement with grooves (24) provided in a receptacle (23) formed by said hub (22) of said drive wheel (20).

16. Massage apparatus according to claim 1, wherein said upper receptacle (29) of said drive unit (27) has longitudianlly extending ribs (30) thereon which mate with grooves on said inserted insertable portion (39) and thereby produce the operative engagement between said drive unit (27) and said drive shaft (41).

17. Massage apparatus according to claim 1, wherein an inner receptacle (47) of said eccentric (33) has a stop (48) facing said massage plate (10) which stop determines the end position of said spring loaded drive unit (27).

18. Massage aparatus according to claim 1, wherein said insertable portion (39) of said drive shaft (41) projects from said bottom (36) of said container (35) a distance such that said drive unit (27) with said container (35) being placed above said massage plate (10) is adjusted to extend into a receptacle (23) of a drive wheel (20) a distance as to be completely disconnected from an inner receptacle (47) of said engagement means (33).

19. Massage apparatus according to claim 1, wherein said impeller (42) is covered on the side of the inner space of the container with a cover plate (43) having apertures (44) therein.

* * * * *